US011692671B2

(12) United States Patent
Tom et al.

(10) Patent No.: US 11,692,671 B2
(45) Date of Patent: Jul. 4, 2023

(54) APPARATUS AND METHOD FOR DISPENSING GAS FROM A STORAGE VESSEL

(71) Applicant: NuMat Technologies, Skokie, IL (US)

(72) Inventors: Glenn McPherson Tom, Skokie, IL (US); Ross James Verploegh, Buffalo Grove, IL (US)

(73) Assignee: NuMat Technologies, Inc., Skokie, IL (US)

( * ) Notice: Subject to any disclaimer, the term of this patent is extended or adjusted under 35 U.S.C. 154(b) by 469 days.

(21) Appl. No.: 16/869,158

(22) Filed: May 7, 2020

(65) Prior Publication Data

US 2021/0348723 A1 Nov. 11, 2021

(51) Int. Cl.
*F17C 13/00* (2006.01)
*F17C 13/06* (2006.01)

(52) U.S. Cl.
CPC ..... *F17C 13/002* (2013.01); *F17C 13/06* (2013.01); *F17C 2205/0305* (2013.01); *F17C 2205/037* (2013.01); *F17C 2205/0323* (2013.01); *F17C 2205/0341* (2013.01); *F17C 2205/0382* (2013.01)

(58) Field of Classification Search
CPC ..... B65D 25/48; B65D 25/40; B65D 83/28; F17C 13/04; F17C 13/06; F17C 13/002; F17C 11/00; F16K 15/182; F16K 15/18; F16K 15/1825; A61L 9/127
USPC ..... 220/203.07, 203.04, 203.01; 222/568, 222/567, 566, 187
See application file for complete search history.

(56) References Cited

U.S. PATENT DOCUMENTS 1,979,390 A * 11/1934 Jacobs ..... B67D 1/0418 251/231
2,575,632 A * 11/1951 Lipman ..... F16J 15/38 239/326
2,981,439 A * 4/1961 Huffman ..... F17C 13/002 251/144
3,628,700 A * 12/1971 Dodoghue ..... B05B 11/0059 222/211
4,122,979 A * 10/1978 Laauwe ..... B05B 7/10 239/327
4,186,882 A * 2/1980 Szczepanski ..... B05B 11/043 222/479
4,207,934 A * 6/1980 Scremin ..... F16L 37/12 141/20

(Continued)

OTHER PUBLICATIONS

"Search Report and Written Opinion for PCT/US21/31159", dated Aug. 24, 2021.

*Primary Examiner* — Robert J Hicks
(74) *Attorney, Agent, or Firm* — Paschall & Associates, LLC; James C. Paschall

(57) ABSTRACT

An apparatus is provided for the storage and dispensing of a sorbable gas. The apparatus includes a storage and dispensing vessel constructed and arranged for containing a solid-phase physical sorbent medium having a sorbable gas adsorbed by said sorbent medium. The dispensing vessel includes a top head having a dispensing valve coupled to the vessel for discharging the sorbable gas therefrom. The dispensing valve is in fluid flow communication with a wick that extends below the upper third of the vessel top head. The wick collects the sorbable gas for discharge of the gas through the dispensing valve.

15 Claims, 4 Drawing Sheets

(56) References Cited

U.S. PATENT DOCUMENTS

| | | | | |
|---|---|---|---|---|
| 4,971,226 | A * | 11/1990 | Donoghue | B29C 45/33 222/207 |
| 5,518,528 | A * | 5/1996 | Tom | B01D 53/0407 95/902 |
| 5,704,967 | A | 1/1998 | Tom et al. | |
| 5,761,910 | A * | 6/1998 | Tom | B01D 53/0407 96/108 |
| 5,916,245 | A | 6/1999 | Tom | |
| 5,917,140 | A * | 6/1999 | Tom | B01D 53/0438 96/143 |
| 6,343,476 | B1 | 2/2002 | Wang et al. | |
| 9,518,701 | B2 | 12/2016 | Carruthers | |
| 2002/0192126 | A1 | 12/2002 | Hertzler | |
| 2007/0217967 | A1 | 9/2007 | McDermott et al. | |
| 2009/0266816 | A1* | 10/2009 | Holroyd | F17C 13/04 220/203.01 |
| 2010/0140265 | A1* | 6/2010 | Oberhofer | B67D 1/125 220/203.01 |
| 2016/0341361 | A1 | 11/2016 | Fanger et al. | |
| 2020/0158286 | A1* | 5/2020 | Criel | F17C 1/16 |
| 2020/0165898 | A1* | 5/2020 | Shirley | F16K 27/0209 |
| 2020/0248873 | A1* | 8/2020 | Elzer | F17C 11/00 |
| 2021/0048148 | A1* | 2/2021 | Tom | B05B 12/088 |
| 2021/0181770 | A1* | 6/2021 | Zajac | B60C 29/002 |

* cited by examiner

APPARATUS AND METHOD FOR DISPENSING GAS FROM A STORAGE VESSEL

TECHNICAL FIELD

The field relates generally to storage and dispensing systems for the selective dispensing of gas from a vessel or storage container. Particularly, the field relates to the fluid components that may be held in sorptive relationship to a solid sorbent medium and are desorptively released from the sorbent medium in the dispensing operation.

BACKGROUND

In a wide variety of industrial processes and applications, there is a need for a reliable source of process gas(es). Such process and application areas include semiconductor manufacturing, ion implantation, manufacture of flat panel displays, medical intervention and therapy, water treatment, emergency breathing equipment, welding operations, space-based delivery of liquids and gases, etc.

It is important in the industry to provide a safe and effective way to handle toxic, flammable, corrosive gases at sub-atmospheric conditions. In particular, these gases include dopant gases. Generally, dopant gases are stored in compressed gas cylinders at pressures equal to the gas vapor pressure at a given or at a specific pressure depending upon the properties of the specific gas. The gases serve as a source of dopant material for the manufacturing of semiconductor devices. These dopant gases are used in a tool called an ion implanter. Ion implanters are located within the fabrication area of a semiconductor production facility where several hundreds or even thousands of personnel are engaged in the semiconductor manufacturing process. These tools are operated at very high voltages, typically up to several thousand kilovolts. Due to these high voltages, the dopant source gases must be located at or within the tool itself. Most other semiconductor tools locate source gases outside of the personnel or main production area. One distinct characteristic of the ion implant tools is that they operate at sub-atmospheric pressure. Utilization of the vacuum present at the tool to deliver product from the cylinder creates a safer package in that product cannot be removed from the cylinder package until a vacuum is applied.

One technique for safely delivering sub-atmospheric delivery of dopant gases involves filling a compressed gas cylinder with a physical sorbent material, such as beaded activated carbon, and reversibly adsorbing the dopant gases onto the material. This concept is commonly known as the SDS technology. The desorption process involves applying a vacuum or heat to the sorbent material/cylinder.

The SDS gas storage and dispensing systems typically comprise a storage and dispensing vessel that is constructed and arranged for holding a solid-phase physical sorbent medium. A solid-phase physical sorbent medium is packed into the storage and dispensing vessel at an interior gas pressure and a sorbate gas is physically introduced to be adsorbed by the solid-phase physical sorbent medium. A dispensing assembly is coupled in gas flow communication with the storage and dispensing vessel and constructed and arranged to provide, exteriorly of the storage and dispensing vessel, a pressure below the interior pressure, to effect desorption of the sorbate gas from the solid-phase physical sorbent medium by the gas flow of desorbed gas through the dispensing assembly. The solid-phase physical sorbent medium in the vessel is devoid of trace components such as water, metals, and oxidic transition metal species (e.g., oxides, sulfites and/or nitrates) which would otherwise decompose the sorbate gas in the storage and dispensing vessel. By the elimination of such trace components from the solid-phase physical sorbent medium, the annual decomposition of the sorbate gas at room temperature and interior pressure conditions is maintained at extremely low levels, e.g., no more than 1-5% by weight.

Typically, in such dispensing systems, the upper end of the vessel, at a port to which a valve head is joined, features a porous centered tube, composed of a foraminous or otherwise gas-permeable structure, or stub filter that extends about an inch into the bed of sorbent medium. The filter serves to prevent entrainment in the dispensed gas of particulate solids from the bed and allow sorbate gas released by the sorbent medium to flow to the valve head.

Stub filters have disadvantages in that they require increased pressure across the filter to provide for any given flow. Additionally, since the path length is long, diffusion from remote parts of the bed, such as from the bottom of the bed, is hindered, thereby increasing the desorption time of the sorbate gas from the sorbent medium. Additionally, adsorption time for recharging the vessel with sorbate gas is also increased due to the long path length through the sorbent medium bed.

Therefore, it is an object of the present invention to provide a storage vessel having a wick that will decrease the pressure drop across the filter for any given flow and shorten adsorption and desorption time.

SUMMARY

This disclosure relates to an apparatus of a storage vessel and a method for selectively dispensing gas from the storage vessel.

In a first embodiment, an apparatus is provided for the storage and dispensing of a sorbable gas. The apparatus includes a storage and dispensing vessel constructed and arranged for containing a solid-phase physical sorbent medium having a sorbable gas adsorbed by the sorbent medium. The dispensing vessel includes a top head having a dispensing valve coupled to the vessel for discharging the sorbable gas therefrom. The dispensing valve is in fluid flow communication with a wick that extends from the top head to below the head or a top surface of the bed. The wick collects the sorbable gas for discharge of the gas through the dispensing valve.

In a second embodiment, a method for storage and dispensing of a sorbable gas is provided. The method includes providing a storage and dispensing vessel constructed and arranged for holding a solid-phase physical sorbent medium. The storage and dispensing vessel is filled with a solid-phase physical sorbent medium, and a sorbable gas is added to the storage and dispensing vessel to be physically adsorbed by the solid-phase physical sorbent medium. A dispensing valve is attached to the storage and dispensing vessel which is in fluid flow communication with a wick that extends to below a top surface of the bed or to the bottom third of the sorbent medium. The dispensing valve dispenses the sorbable gas collected by the wick.

In a third embodiment, a process for manufacturing a vessel for the dispensing of a sorbable gas is provided. A process includes providing a vessel for holding a solid-phase sorbent medium. The vessel has a top head and an orifice extending through the top head from the interior of the vessel to the exterior of the top head. A slurry of solid-phase sorbent medium is packed into the vessel through the orifice.

Next, a tube is installed into the vessel through the orifice extending axially into the vessel to at least the top third of the sorbent medium. The sorbent medium in the vessel is dried and the tube removed. A wick is then installed in a void created in the sorbent medium and a dispensing valve attached to the orifice.

In a fourth embodiment, another process for manufacturing a vessel for the dispensing of a sorbable gas is provided. In the fourth embodiment, the process includes providing a vessel for holding a solid-phase sorbent medium. The vessel has a top head and an orifice extending through the top head from the interior of the vessel to the exterior of the top head. A wick is wrapped around a tube and the tube installed in the vessel to at least the top third of vessel. Next a dry solid-phase sorbent medium is poured into the vessel under vibration. Once the vessel is filled with the sorbent medium, the tube is removed leaving the wick behind in the sorbent medium. A sorbable gas is then introduced to the vessel to be physically adsorbed by the sorbent medium and a dispensing valve attached to the orifice.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The present invention provides a new improved SDS atmospheric pressure storage and delivery system apparatus as a source gas supply means for applications such as ion implantation of hydride and halide gases, and organometallic Group V compounds, such as arsine, phosphine and chlorine. The SDS gas source system is comprised of a leak-tight gas vessel, such as a gas cylinder, containing the gas to be dispensed, e.g., arsine or phosphine, adsorbed onto a sorbent medium comprising molecular organic framework (MOF), zeolite or other suitable physical adsorbent material.

Since the storage and delivery system is initially at atmospheric pressure, the release rate is controlled primarily by diffusion instead of a pressure differential. The storage and delivery system apparatus and method of the present invention is about $1\times10^5$ safer than compressed gas sources.

While the invention is discussed primarily hereinafter in terms of the storage and delivery of arsine and phosphine gases, it will be recognized that the utility of the present invention is not thus limited, but rather extends to and is inclusive of various other hydride and halide gases, as for example silane, germane, ammonia, stibine, hydrogen sulfide, hydrogen selenide, hydrogen telluride, and corresponding and other halide (chlorine, bromine, iodine, and fluorine) gaseous compounds such as $NF_3$, and organometallic Group V compounds such as $NF_3$ and $(CH_3)_3Sb$.

Current known SDS storage and delivery systems involve the adsorption of gases onto a physical adsorbent such as, for example, a MOF or zeolite 5A. By adsorbing the gas into a suitable solid physical sorbent, the vapor pressure of the gas can be reduced to ≤0 psig. The release potential from this system is greatly reduced as the driving force of pressure is eliminated. Collectively, the storage and delivery system may usefully consist of a standard gas cylinder and cylinder valve, loaded with dehydrated zeolite 5A. The cylinder is subsequently filled to 1 atmosphere with the hydride gas. Zeolite 5A has $\sim2.5\times10^{21}$ hydride adsorption sites per gram. A liter of zeolite will adsorb 100 grams of phosphine and 220 grams of arsine at 25° C. and 1 atmosphere.

Gas flow from an SDS storage and delivery system is established using the existing pressure differential between the storage and delivery system and the ion implant vacuum chamber or other downstream use locus. Utilizing a device such as a mass flow controller, a constant flow can be achieved as the sorbent container pressure decreases. However, in current SDS vessel construction where in certain cases the sorbent medium particle size is smaller (≈5 μm) the movement of gases through the vessel becomes increasingly slower due to greater pressure drops.

Figure 1:
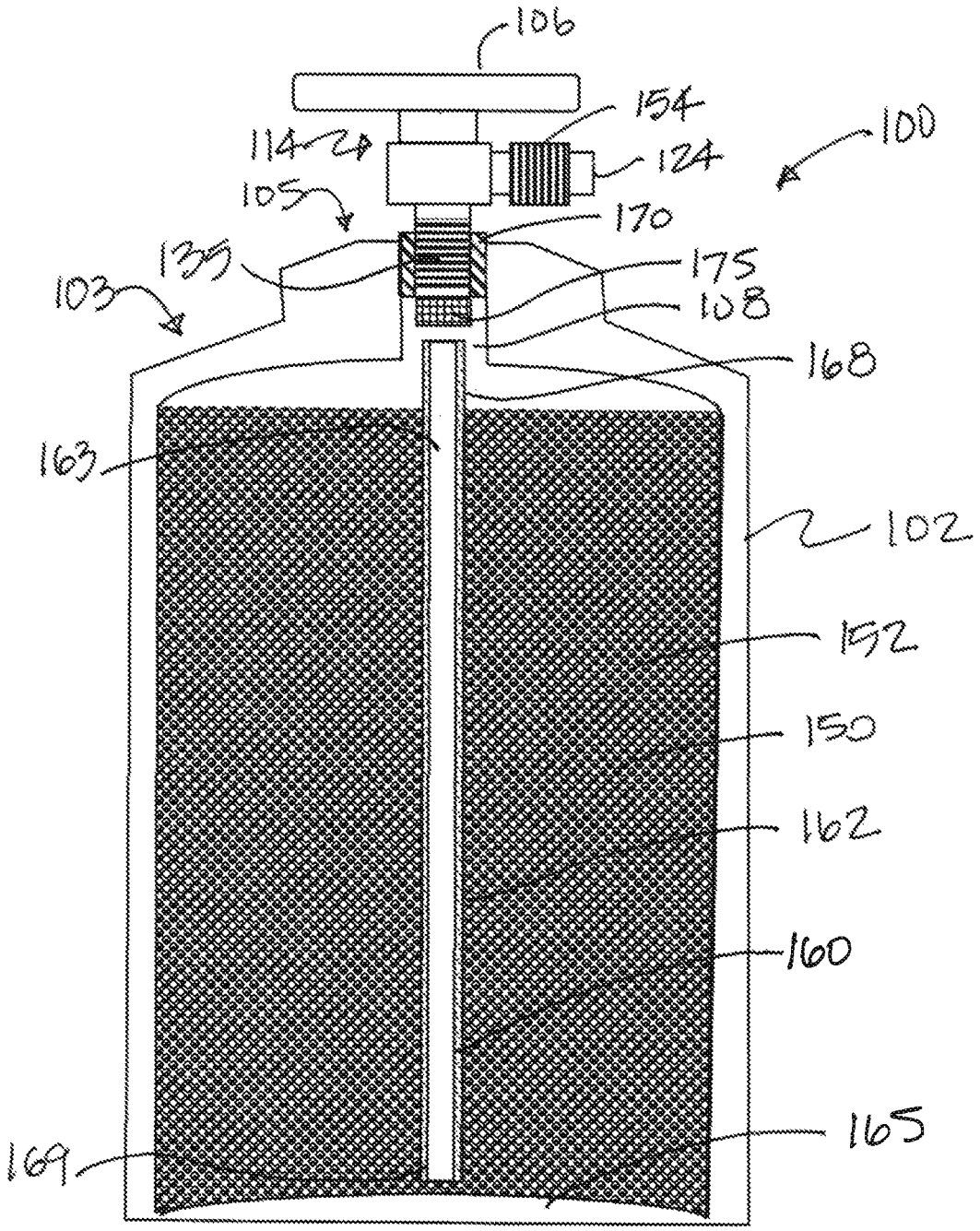
FIG. 1 is a schematic cross-sectional view illustrating the gas storage and dispensing system in accordance to this disclosure.

FIG. 1 is a schematic cross-sectional view of a storage vessel 100 which relies on an adsorbent in the vessel to avoid unintended discharge. FIG. 1 shows the interior structure of the storage vessel 100. As shown, the storage vessel 100 comprises a wall 102 enclosing an interior volume 152 containing a particulate solid-phase sorbent medium 150 deposited therein. The vessel 100 further includes a top head 103 that vaults upwardly from walls 102 to a dome 105. Dome 105 of the vessel includes a valve assembly 114, a vessel port 108, and a threaded dome fitting 170. The dome fitting 170 includes internal threaded surfaces and external threaded surfaces. The external threaded surfaces engage complimentary threads in the port 108 and is arranged to fix the dome fitting 170 thereto. A course wire frit cup 175 with external threads is screwed into complementary internal threads of the valve 114. As can be best seen at FIG. 1, the frit cup 175 is composed of a wire screen that allows passage of gas through the frit cup 175 but blocks passage of any sorbent medium therethrough. The frit cup 175 has threaded top member 178 having external threads. The external threads of top member 178 engage the internal threads of threaded neck 130 of valve assembly 114. The diameter of the frit cup 175 is designed to pass through the interior of the dome fitting 170 as to not impede the installation of the threaded neck 130 onto dome fitting 170. The valve assembly's threaded neck 130 also includes external threads 135 that engage the internal threads of the dome fitting 170. The valve assembly 114 is screwed into the dome fitting 170 until a fluid tight seal is made. The valve assembly also includes a nozzle 124 for dispensing gas from and charging gas to, the storage vessel 100. The nozzle 124 may have external threads 154 for a male connection with a gas tube having an end fitting with corresponding internal threads.

The valve assembly 114 further includes a passage 120, having a first end 121 in communication with the nozzle 124 and a second end 123 in fluid communication with frit cup 175 and the interior volume 152 of the storage vessel. A shut-off gate 122 is operated by a wheel/handle 106. A stem 110 connected to shut-off gate 122 controls the travel of the shut-off gate 122. The shut-off gate 122 is interposed between first end 121 and the second end 123 of passage 120 and is arranged to be moved by stem 110 when the wheel/handle 106 is operated to either block or allow gas to pass through the passage 120.

Dispensing of gas from the storage vessel 100 from its interior volume 152 is made with nozzle 124. This can be initiated by opening the shut-off gate 122 with wheel/handle 106 to allow equalization of pressure down passage 120. A tube may be connected to nozzle 124 at one end and to a source of gas at subatmospheric pressure at the other end of the tube. By operating the wheel handle 106 to open shut-off gate 122, the subatmospheric pressure is communicated to the sorbent medium 150 and the gas adsorbed thereon desorbed from the sorbent medium 150. The desorbed gas passes through frit cup 175 and passage 120 and is dispensed from nozzle 124.

The storage vessel 100, further includes a porous gas-permeable tube structure or wick 160. Wick 160 is comprised of a hollow interior 163 surrounded by a wall 162. The wick 160 may be a cylindrical tube having one wall, but it may be a polygonal, cross sectional tube which would include several walls 162. The wall 162 may be composed of a foraminous material. The wick 160 extends axially in the center of the vessel 100 from the top head 103 of the vessel. A top end 168 of wick 160 extends outward of a surface 155 of bed 150 of the sorbent medium and is spaced apart from frit cup 175 and valve assembly 114. The wick 160 may extend below surface 155 of the bed 150, into a top third, below a top third, below a top half or into a bottom third of the interior volume 152 of the vessel. FIG. 1 illustrates the wick 160 having a bottom end 169 that extends to near an interior bottom surface 165 of the vessel 100 for ease of explaining the invention, however, the invention is not limited to this configuration.

The wick 160 serves to collect gas dispensed by the sorbent medium, as well as, to prevent entrainment of particulate solids from the sorbent medium 150 in the dispensed gas. Desorbed gas passes through foraminous material wall 162 and enters the hollow interior 163 of wick 160 where it rises to the frit cup 175 to be eventually dispensed by valve assembly 114. The wick 160 shown in FIG. 1, that extends to near a bottom surface 165 of the vessel 100, has approximately twice the surface area of currently known stub filters and therefore exhibits less of a pressure drop across the wick for any given flow path. Additionally, due to a lack of large differences in material density between the top and bottom of the sorbent medium 150, the wick 160 will provide uniform collection of the gas from all of the layers of the bed 150 of the sorbent medium. This advantage is due to the dispensed gas entering the wick across the entire central height of the wick and perhaps the vessel instead of just across the top surface of the bed of sorbent medium.

Figure 3:
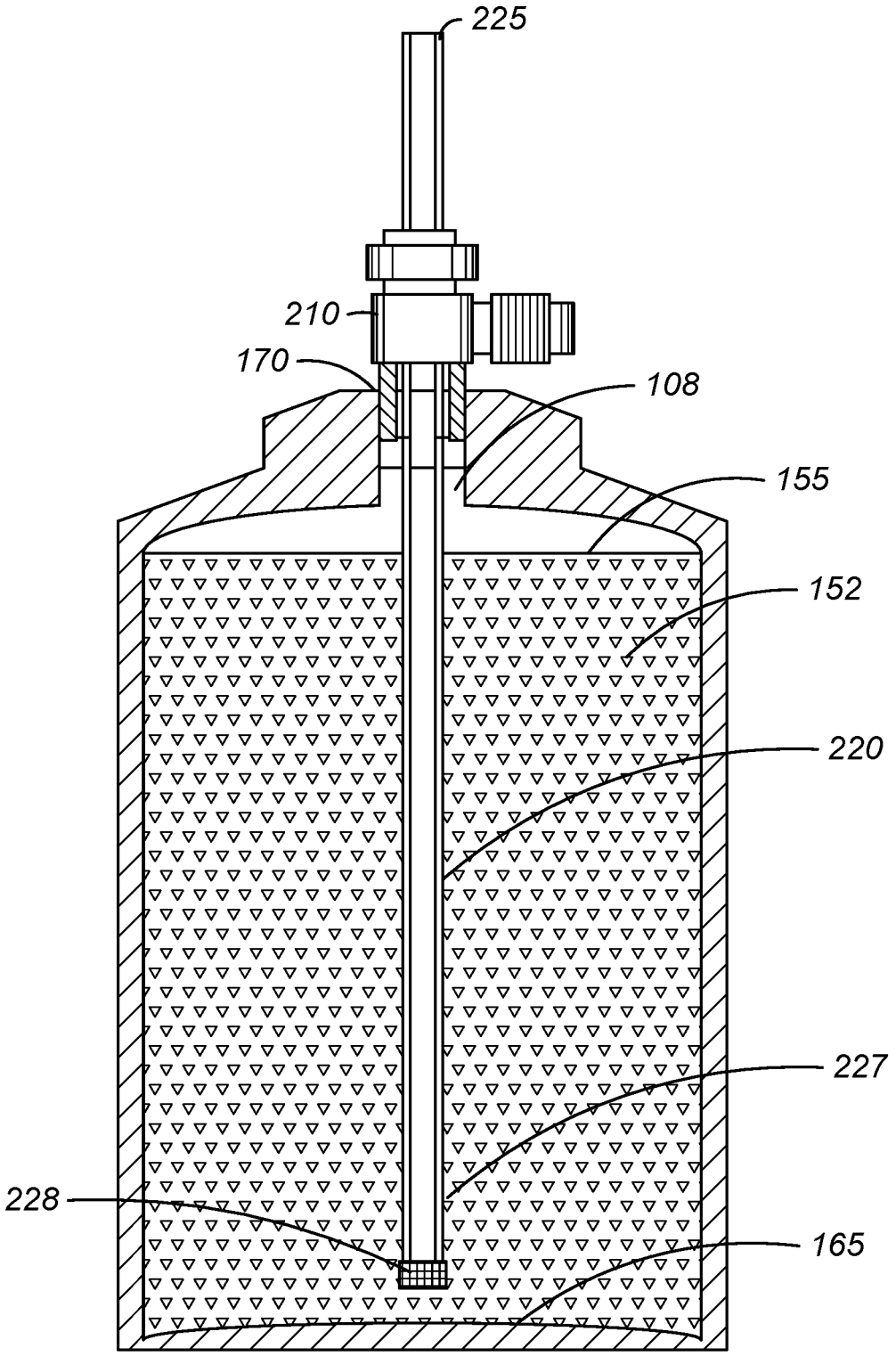
FIG. 3 is schematic cross-sectional view illustrating an example of a first step in assembling the gas storage and dispensing system of FIG. 1 in accordance to this disclosure.
Figure 4:
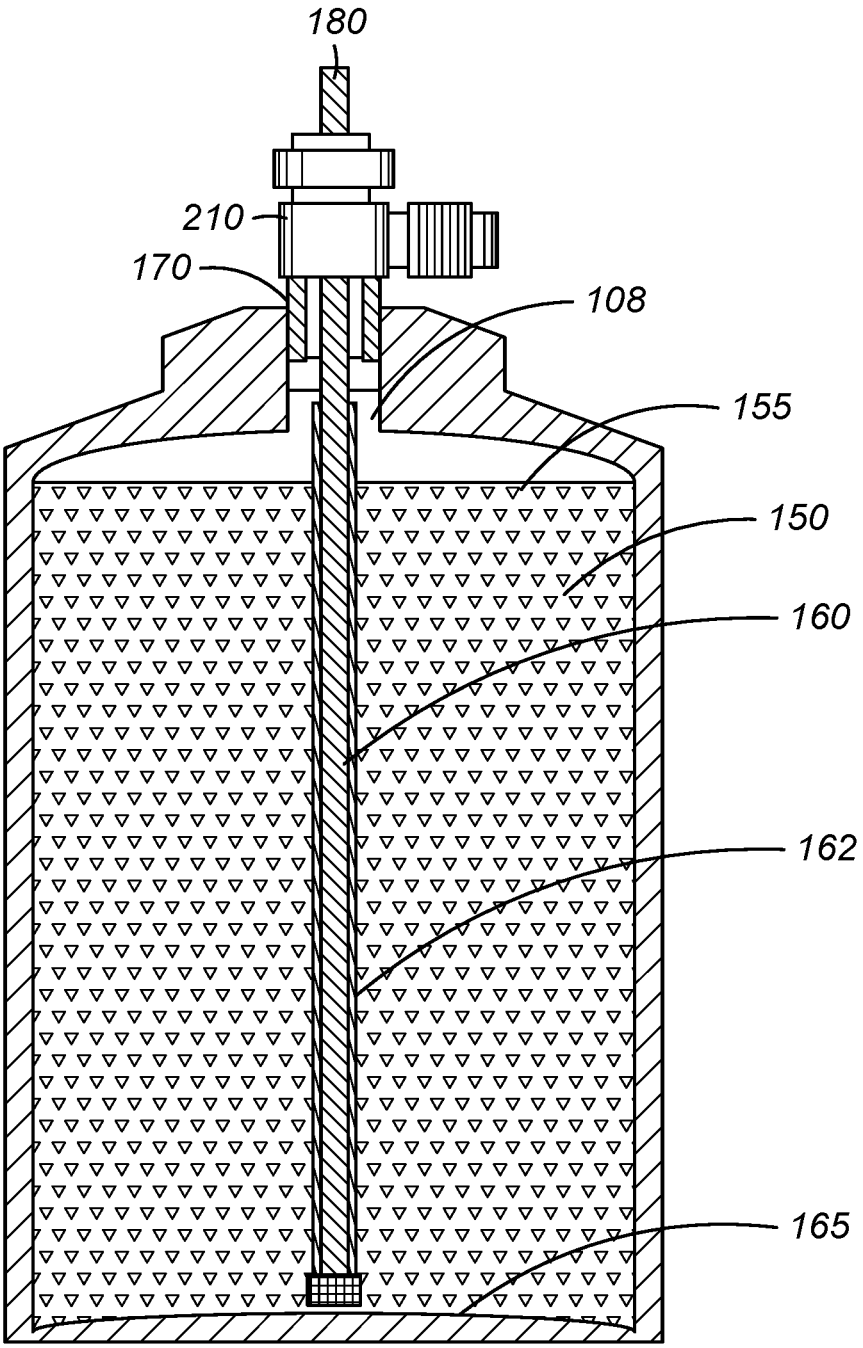
FIG. 4 is a schematic cross-sectional view illustrating an example of a second step in assembling the gas storage and dispensing system of FIG. 2 in accordance to this disclosure.

Turning to FIG. 3 and FIG. 4 a preferred procedure for filling the vessel 200 with sorbent medium and installing the wick 160 into vessel 100 will be explained. With the vessel 100 empty and valve assembly 114 removed, a slurry of a sorbent medium, such as NuMat 25, in a liquid solvent such as methanol, is poured into the vessel interior volume 152. A male run tee junction 210 is then installed into the dome fitting 170 of vessel 100. The male run tee junction 210 has external threads that screw into the internal threads of dome fitting 170 to provide a T-junction.

A hollow tube 220 that has a smaller outer diameter than an inner diameter of the male run tee junction 210 and the dome fitting 170 has a bottom end 227 inserted through the tee junction 210 into the vessel interior volume 152 and pushed through the slurry of sorbent medium. A filter or screen 228 is installed at the bottom end 227 of the tube 220 to keep the slurry from clogging the tube when it is inserted into the vessel. It should be noted, that the tube can also be pushed through the sorbent medium to other depths than what is illustrated in FIG. 3, including below the top surface 155, into or below the top one-third, the top half, or bottom one-third of the bed of sorbent medium 150 and is not limited to the being located near the vessel bottom surface 165.

A source of an inert gas such as nitrogen is connected to a top end 225, of tube 220 in any convenient manner and nitrogen gas pumped into the tube 220. The nitrogen gas enters the vessel through the bottom 227 of tube 220 and exits filter 228 into the slurry, to drive out the liquid solvent contained in the slurry by evaporation. The evaporated solvent exits the vessel through the gap between tube 220 and the male run tee junction 210 provided by the differential diameters.

After a first stage of drying, the tube 220 is carefully removed from the vessel 100 through the top of the male run tee junction 210 leaving a tubular void in the sorbent medium 150 for approximately the depth of the tube 220 in the sorbent bed.

As can be seen in FIG. 4, the wick 160 is next installed by wrapping the wick 160 around a solid rod 180. The assembly of the rod and wick 160 is then driven into the tubular void formed in the bed of sorbent medium 150 by tube 220. After driving the assembly to a selected depth in the bed of sorbent medium 150, the rod 180 is carefully extracted through the top of the tee junction 210 leaving the wick 160 behind in place. The wick 160 takes the shape of a cylindrical tube having its foraminous material wall 162 installed against the sorbent medium 150.

Figure 2:
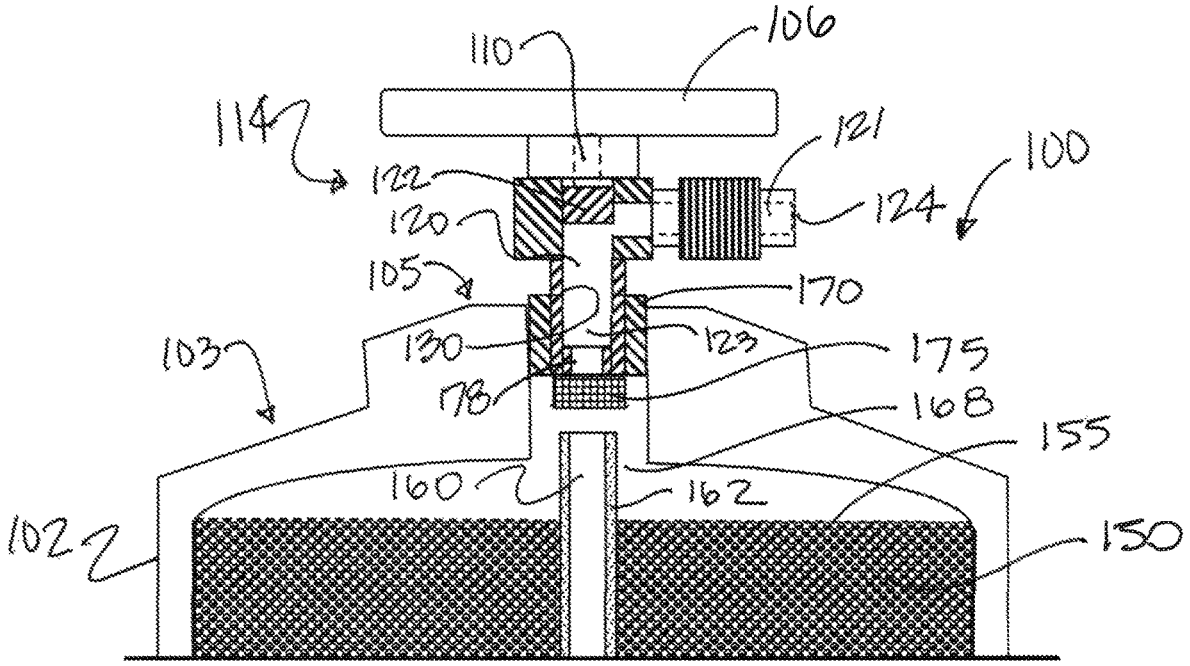
FIG. 2 is a schematic cross-sectional view through the valve assembly in accordance to this disclosure.

Next the valve assembly 114 with the course wire frit cup 175 is screwed into dome fitting 170 in the manner explained above in FIG. 1 and FIG. 2. As can be seen in FIG. 1, the valve assembly 114 is screwed into the dome fitting 170 of vessel 100 to position the wire frit cup 175 spaced apart from the top end 168 of the wick 160. The assembled vessel 100 is then placed in a vacuum oven to vaporize any excess solvent which exits through the open valve assembly 114 thereby activating the bed 150 of sorbent medium. The cylinder 100 is next pressurized with an inert gas such as helium, leak checked, the helium extracted, and filled with the sorbable gas through valve opening 124 of valve 114. The sorbable gas sorbs onto the sorbent material in the bed 150.

In another preferred embodiment vessel 100 may be vibrationally dry-packed with the sorbent medium 150. In this procedure, the wick 160 is installed by wrapping the wick 160 around solid rod 180 as was done in the previous embodiment. However, in this embodiment, the assembly consisting of the wick 160 and rod 180 are installed before the sorbent medium is poured into the vessel. The assembly of the rod 180 and wick 160 is placed in the storage vessel to a selected depth and a dry sorbent medium 150 such as NuMat 25, poured into vessel 100. The vessel 100 is vibrated at a convenient frequency as the sorbent medium 150 is introduced into the vessel 100. The vibrations uniformly distribute the sorbent medium 150 in the vessel creating a consistent packed bed in the vessel surrounding the assembly of the rod 180 and wick 160. After the filling the vessel, rod 180 is carefully extracted through the top of the tee leaving the wick 160 behind in place. The wick 160 takes the shape of a cylindrical tube having its foraminous material wall 162 installed against the sorbent medium 150.

Next the valve assembly 114 with the course wire frit cup 175 is screwed into dome fitting 170 in the manner explained above in FIG. 1 and FIG. 2. As can be seen in FIG. 1, the valve assembly 114 is screwed into the dome fitting 170 of vessel 100 to position the wire frit cup 175 spaced apart from the top end 168 of the wick 160. The assembled vessel 100 is then placed in a vacuum oven to vaporize any excess solvent which exits through the open valve assembly 114 thereby activating the bed 150 of sorbent medium. The cylinder 100 is next pressurized with an inert gas such as helium, leak checked, the helium extracted, and filled with the sorbable gas through valve opening 124 of valve 114. The sorbable gas sorbs onto the sorbent material in the bed 150.

While the following is described in conjunction with specific embodiments, it will be understood that this description is intended to illustrate and not limit the scope of the preceding description and the appended claims.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. An apparatus for storage and dispensing of a sorbable gas, said apparatus comprising:

a storage and dispensing vessel constructed and arranged for containing a solid-phase physical sorbent medium and a sorbable gas adsorbed by said sorbent medium, wherein said vessel having a top head that includes a threaded orifice on an interior surface of said vessel top head extending axially to an exterior surface of said top head with said threaded orifice accepting a threaded dome fitting therethrough; and a dispensing valve coupled to the vessel for discharging said sorbable gas therefrom, said dispensing valve in fluid flow communication with a wick that extends from the top head to below the upper third of said sorbent medium, said wick collecting said sorbable gas, wherein said dome fitting further including interior threaded surfaces and said dispensing valve includes a threaded input port arranged to engage the dome fitting interior threaded surfaces mechanically attaching said dispensing valve to said vessel top head allowing passage of said sorbable gas into said dispensing valve for the discharge of said sorbable gas through said dispensing valve.

2. The apparatus according to claim 1, further including a wire frit cup attached to a bottom neck of said dispensing valve.

3. The apparatus according to claim 2, wherein said dispensing valve includes an output port and a handle, said handle arranged to be rotated in a first direction to open and allow said sorbable gas to flow out from said dispensing valve output port or alternatively, rotated in a second direction to close and stop the flow of sorbable gas through said dispensing valve.

4. The apparatus according to claim 3, wherein said dispensing valve output port is arranged to mechanically connect said output port to tubes, hoses or other devices for conveying sorbable gas from said dispensing valve.

5. The apparatus according to claim 1, wherein said wick is a tube having a wall composed of a foraminous gas-permeable material, said wick extending axially through said vessel interior and having a first end in fluid flow communication with said dome fitting.

6. The apparatus according to claim 5, wherein said wick further includes a second end located below the upper third of said vessel.

7. The apparatus according to claim 6, wherein said second end of said wick is in close proximity to an interior bottom surface of said vessel.

8. The apparatus according to claim 5, wherein said vessel contains said solid-phase physical sorbent medium and said wick extends into said sorbent medium.

9. The apparatus according to claim 8, wherein said vessel contains a sorbable gas physically adsorbed by said sorbable medium.

10. A method for storage and dispensing of a sorbable gas, the method comprising:

providing a storage and dispensing vessel constructed and arranged for holding a solid-phase physical sorbent medium, wherein said storage and dispensing vessel includes a top head and said top head includes a threaded orifice on an interior surface of said top head extending axially to an exterior surface of said top head with said threaded orifice accepting a threaded dome fitting therethrough, said dome fitting further including interior threaded surfaces;

filling said storage and dispensing vessel with a solid-phase physical sorbent medium;

adding a sorbable gas to said storage and dispensing vessel to be physically adsorbed by said solid-phase physical sorbent medium;

attaching a dispensing valve to said storage and dispensing vessel said dispensing valve including a threaded input port arranged to engage the dome fitting interior threaded surfaces mechanically attaching said dispensing valve to said vessel top head and allow passage of said sorbable gas into said dispensing valve, wherein said dispensing valve is in gas flow communication with a wick that extends below the upper third of said sorbent medium; and, dispensing said sorbable gas collected by said wick through said dispensing valve.

11. The method of claim 10, further including a wire frit cup coupled to a bottom neck of said dispensing valve.

12. The apparatus according to claim 10, wherein said wick is a tube having a wall composed of a foraminous gas-permeable material extending axially through said vessel interior and having a first end in fluid flow communication with said dome fitting.

13. The method according to claim 12, wherein said wick further includes a second end located below the upper third of said vessel.

14. The method according to claim 12, wherein said sorbent medium is selected from the group consisting of zeolites, activated carbon and metal organic frameworks (MOFs).

15. The method according to claim 10, wherein said sorbable gas is selected from the group consisting of multiphase fluids, halide gaseous compounds, organo compounds, and organometallic compounds, including arsine, phosphine, and boron trifluoride.

* * * * *